United States Patent [19]

LoBello

[11] Patent Number: 5,059,943

[45] Date of Patent: Oct. 22, 1991

[54] CONTROL UNIT FOR INDICATING THE STATUS OF A PROCEDURE

[76] Inventor: Peter J. LoBello, 130 Beechwood Dr., Mamaroneck, N.Y. 10543

[21] Appl. No.: 493,782

[22] Filed: Mar. 15, 1990

[51] Int. Cl.[5] ..... G08B 21/00

[52] U.S. Cl. ..... 340/309.4; 340/540; 340/815.3; 368/89; 368/107; 368/243

[58] Field of Search ..... 340/309.4, 540, 815.3, 340/815.02, 815.01, 815.03; 368/89, 107, 109, 10, 97, 98, 108, 243, 244

[56] References Cited

U.S. PATENT DOCUMENTS

| | | | |
|---|---|---|---|
| 2,348,431 | 5/1944 | Warmey et al. | 340/815.02 |
| 2,932,779 | 4/1960 | Tancig | 340/309.4 |
| 4,803,854 | 2/1989 | Kikuchi et al. | 340/309.4 |

*Primary Examiner*—Glen R. Swann, III

*Attorney, Agent, or Firm*—Fitzpatrick Cella Harper & Scinto

[57] ABSTRACT

A control unit for indicating the status of a procedure is provided with a first indicator for indicating that the start of the procedure is imminent, a second indicator for indicating that the procedure has commenced, and a third indicator for indicating that the procedure is complete. A controller is provided to ensure that only one of the second and third indicators is energized after the procedure has been commenced and that neither indicator is energized until the procedure has commenced. Remote indicator units having their own sets of first, second and third indicators that operate in slaved configuration with the first, second and third indicators may also be provided. When used in connection with a treatment room, the first indicator also indicates that the room is occupied.

16 Claims, 2 Drawing Sheets

CONTROL UNIT FOR INDICATING THE STATUS OF A PROCEDURE

INTRODUCTION

The present invention pertains to a control unit for indicating the current status of a procedure and particularly to a control unit for indicating when the start of a procedure is imminent, when the procedure has been commenced, and when the procedure is complete.

Such a control unit is particularly useful in situations where it is impractical to monitor the status of the procedure directly. For example, a doctor's office or chiropractor's clinic is often provided with several treatment rooms in which patients undergo a variety of therapeutic procedures (for example, heat massage and hydrotherapy). To use the rooms effectively, the doctor must know, for each room, that a patient is in the room and that the start of the therapeutic procedure is imminent. The doctor must also know for each room whether the procedure has commenced, and whether the procedure is complete.

Directly monitoring the rooms, is, of course, impractical. If there are several treatment rooms, the time spent simply checking status is burdensome. Moreover, checking the room is potentially embarrassing to the patient, and, to some extent, may be viewed as an unprofessional intrusion. Accordingly, a unit for indicating the current status of the procedure is needed.

SUMMARY OF THE INVENTION

It is an object of the present invention to provide a control unit in which a plurality of indicators indicate the status of a procedure.

Briefly, according to the invention, a control unit is provided with a first indicator for indicating that the start of the procedure is imminent, a second indicator for indicating that the procedure has commenced, and a third indicator for indicating that the procedure is complete. Means are provided for controlling the second and third indicators so that only one of said second and third indicators is operable after the procedure has commenced. Preferably, switching means may be provided to ensure that neither indicator is operable until the procedure has actually commenced. One or more remote indicator units may also be provided, each of the remote indicator units having its own set of first, second and third indicators which operate in accordance with the first, second and third indicators of the control unit.

This brief summary is provided so that the nature of the invention may be understood easily. A complete understanding of the invention may be obtained by reference to the following description of the preferred embodiment with reference to the attached drawings, which form a complete part of this application.

DETAILED DESCRIPTION OF THE PREFERRED EMBODIMENT

To provide a concrete example of utility, the preferred embodiment of a control unit according to the present invention will be explained in the context of its use in a doctor's office. It will be understood that the control unit has a general applicability in situations where it is desirable to indicate that the start of a procedure is imminent, that the procedure has commenced, and that the procedure is complete. Thus, for example, the invention is applicable in tanning salons, photographic dark rooms, chiropractic, clinics and doctors' offices, etc.

Figure 1:
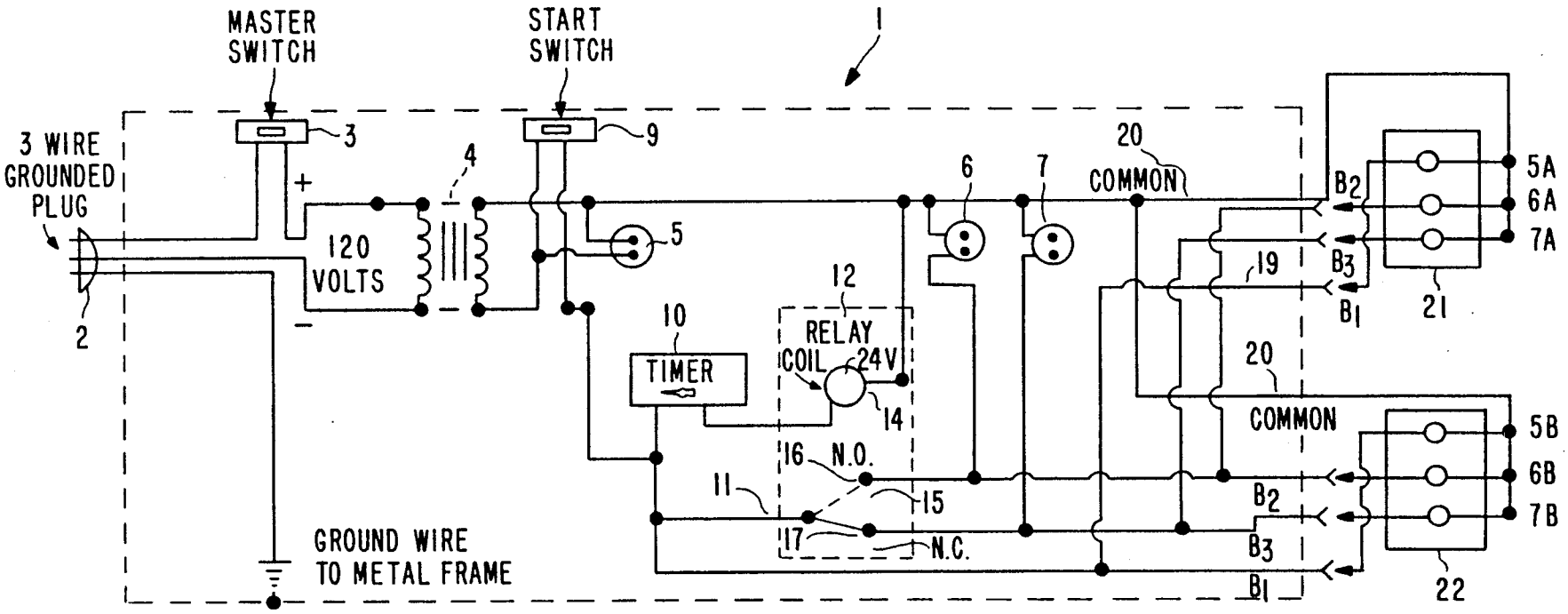
FIG. 1 is a schematic diagram of a control unit, together with associated remote indicator units, according to the preferred embodiment of the invention.

In the schematic of FIG. 1, box 1 generally indicates a control unit according to the present invention. Control unit 1 is provided with a three-wire line power plug 2 which serves to introduce standard 110–120 volts AC into the unit and to ground the metal frame of box 1. Master switch 3 turns control unit 1 on and off, and is provided in a series with transformer 4. Transformer 4 serves to lower line voltage to safe levels, for example, 24 volts AC.

The first leg of transformer 4 is connected to first indicator 5, second indicator 6 and third indicator 7. As described below, the first indicator is used to indicate that the procedure is imminent. If the control unit is used in connection with a treatment room, then the first indicator also indicates that the room is occupied. The second indicator is used to indicate that the procedure has commenced, and the third indicator is used to indicate that the procedure is complete. In the preferred embodiment illustrated in FIG. 1, the first, second and third indicators are constituted by an amber, red and green lamp, respectively. The different colors aid in discriminating the current status of the procedure.

The second leg of transformer 4 is connected to start switch 9. Start switch 9 is, in turn, connected to timer 10 and to common terminal 11 of relay 12.

Timer 10 is of a conventional variety, and is used to measure an arbitrarily selectable time period. Conveniently, a mechanical wind-up timer may be used. Mechanical wind-up timers are wound to a degree corresponding to the selected time period. Such a timer also includes an internal switch (not shown) which, during the time period, is closed, and at the end of the time period is opened.

Relay 12 is also conventional, and includes a magnetic coil 14 which controls the contacts of internal single Pole/double throw switch 15. Switch 15 includes the aforementioned common terminal 11, normally open contact 16, and normally closed contact 17.

Referring to FIG. 1, timer 10 is further connected to one terminal of coil 14. The other terminal of coil 14 is connected to the first leg of transformer 4.

Normally open contact 16 of relay 12 is connected to second indicator 6. Normally closed contact 17 of the relay is connected to third indicator 7.

If desired, the four wires that together control operation of indicators 5, 6 and 7 may be extended to an external jack which interfaces with remote indicator units. In FIG. 1, two such jacks, 19 and 20, are shown, each provided with terminals connected to the wires labelled "common", "B1", "B2" and "B3".

Two remote indicator units 21 and 22 are shown in FIG. 1; they interface to control unit 1 through jacks 19 and 20, respectively. Such a configuration permits local determination of status through control unit 1, as well as remote determination of status through remote indicator units 21 and 22. In the context of a doctor's office, control unit 1 is typically disposed in the treatment room itself so that it may be operated in coordination with the treatment being afforded to the patient. One remote unit would typically be disposed outside the treatment room; this allows immediate determination of the status of the procedure within the treatment room without the need to open the room. The second remote unit 22 is placed in a centralized location together with similar second remote units that are associated with other treatment rooms; this allows determination of the status of the procedures in all treatment rooms in the office by reference to single place, for example, a nurse's station.

Each remote indicator unit is provided with its own set of first, second and third indicators. These indicators are slaved to indicators 5, 6 and 7 of control unit 1. Thus, as shown in FIG. 1, remote indicator unit 21 has indicators 5A, 6A and 7A which operate in correspondence with indicators 5, 6 and 7 of control unit 1; second remote indicator unit 22 has indicators 5B, 6B and 7B that operate in the same manner. As shown in FIG. 1, cables from each remote indicator unit provide access with jacks 19 and 20 on control unit 1.

Figure 2:
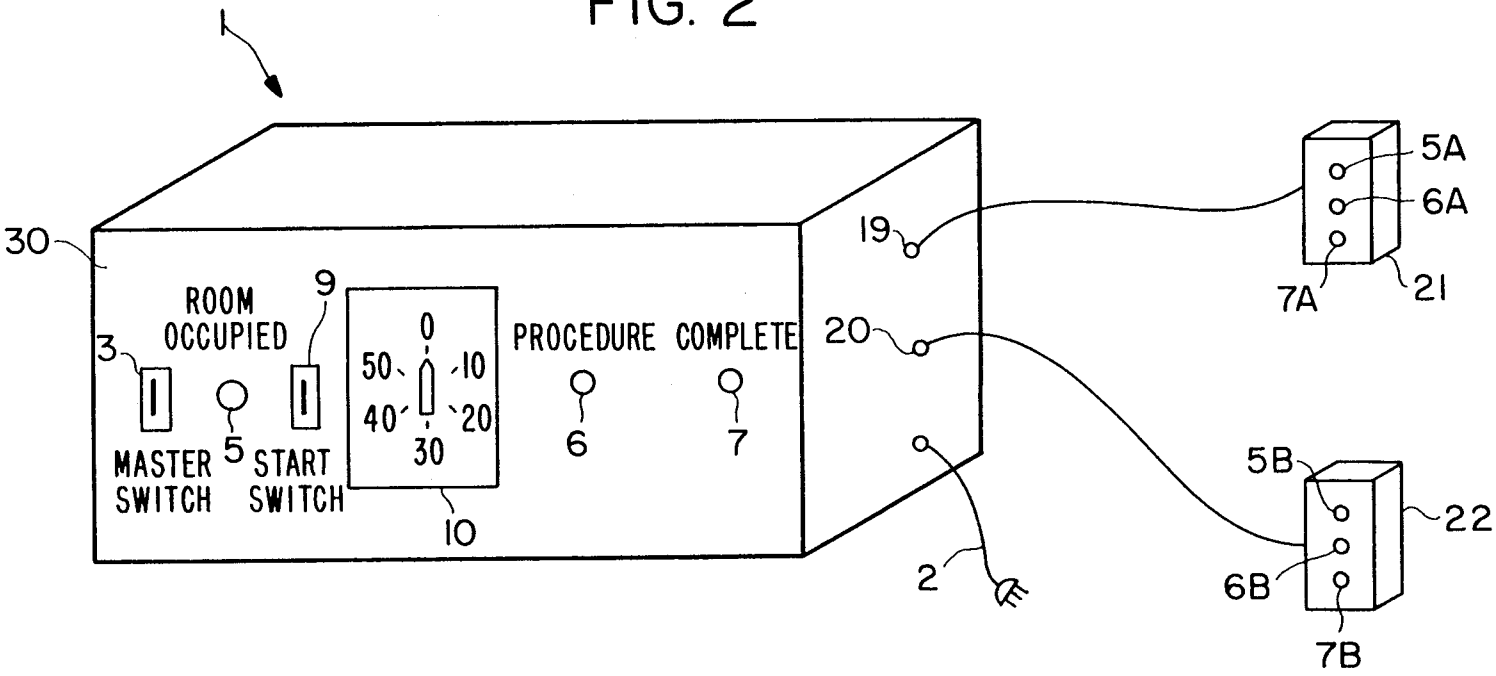
FIG. 2 is a perspective view of the external appearance of the embodiment shown in FIG. 1.

FIG. 2 is a view of the external appearance of a control unit according to the present invention in which reference units that were used in FIG. 1 designate the same element in FIG. 2. As seen in FIG. 2, panel 30 of control unit 1 includes master switch 3, first indicator 5, start switch 9, timer 10, second indicator 6 and third indicator 7. Power plug 2 extends from the side of housing 31, where jacks 19 and 20 are also provided. Remote indicators 21 and 22 are shown with their respective sets of first, second and third indicators.

In use, control unit 1 is placed in the treatment room of the doctor's office. Remote indicator unit 21 is placed outside the room, and remote indicator unit 22 is placed at the nurse's station.

Upon entering the treatment room with a patient, master switch 3 is turned on, consequently lighting first indicator 5 (the amber lamp). Since indicators 5A and 5B are slaved to the operation of indicator 5, amber lamps will be lit both outside the room and at the nurse's station. The amber lamps show that the patient is ready for treatment and that the room is occupied.

When the treatment is to be commenced, the timer is set for the time period desired for treatment, and start switch 9 is turned on. It will be appreciated that until start switch 9 is turned on, both second and third indicators 6 and 7 will remain off indicating that treatment has not yet commenced. That is, start switch 9 allows an unambiguous indication that the procedure has not yet started. Without start switch 9, one or the other of second and third indicators 6 and 7 would always be lit when master switch 3 was on.

As soon as start switch 9 is turned on, the internal switch of timer 10 actuates coil 14 of relay 12, causing relay switch 15 to move to the normally open position 16, as indicated by the dotted line position in FIG. 1. This energizes second indicator 6 (the red lamp) indicating that the procedure has commenced. Since indicators 6A and 6B are in slave configuration with second indicator 6, these lamps will also light, to provide an indication both outside the room and at the nurse's station that the procedure has commenced.

Timer 10 commences to measure the selected time period. During this time, second indicators 6, as well as corresponding slave second indicators 6A and 6B, remain energized, indicating that the procedure has been commenced and is on-going. If desired, the second indicator 6 may be of an intermittent type to give a "count-down" effect.

When timer 10 reaches the end of the selected time period, its internal switch opens, de-energizing coil 14. Thereupon relay switch 15 moves from the normally open position 16 to the normally closed position 17, as indicated by the solid line in FIG. 1. This energizes third indicator 7 (the green lamp), as well as the slave third indicators 7A and 7B. This shows that the procedure is complete and that the patient is ready for additional treatment if necessary.

When all treatments have been completed, and the patient leaves the room, master switch 3 is turned off. This extinguishes all lamps, including first indicator 5 (and 5A and 5B), to signify that the room is empty and that no procedures are imminent.

Those skilled in the art will appreciate that various modifications of the foregoing embodiment may be made without departing from the spirit of the invention. Accordingly, the invention is not to be measured by the above description, but instead by reference to the following claims.

What is claimed is:

1. A control unit for indicating the status of a procedure comprising:

a first indicator responsive to application of power to said control unit, said first indicator signifying that the start of the procedure is imminent;

a second indicator responsive to a first control signal, said second indicator signifying that the procedure has commenced;

a third indicator responsive to a second control signal, said third indicator signifying that the procedure is complete; and control means for generating the first and second control signals so that only one of said second and third indicators is operable after the procedure has commenced.

2. A control unit according to claim 1, wherein said control unit is used in connection with a treatment room, and power is applied to said control unit so that said first indicator signifies that the room is occupied.

3. A control unit according to claim 1 further comprising means for disabling said second and third indicators so that neither indicator is operable.

4. A control unit according to claim 1 further comprising a jack permitting interface to said first, second and third indicators.

5. A control unit according to claim 4 further comprising a remote indicator unit having a set of first, second and third indicators that operate in slave configuration with said first, second and third indicators of said control unit, said remote indicator unit interfacing with said control unit through said jack.

6. A control unit according to claim 1 wherein said control means comprises a relay having normally open and normally closed contacts functionally connected to said second and third indicators, the coil of said relay being operated in accordance with the progression of a selectable period of time.

7. A control unit according to claim 1, further comprising means manually operable to apply power to said control unit, whereby said first indicator is actuated.

8. A control unit for indicating the status of a procedure comprising:

a first indicator for indicating whether power is supplied to said control unit;

a timer for measuring a selectable period of time;

a second indicator;

a third indicator;

means operable in association with said timer for actuating said second indicator when the selectable period of time has not expired and for actuating said third indicator when the selectable time period has expired.

9. A control unit according to claim 8, wherein said control unit is used in connection with a treatment room, and power is applied to said control unit so that said first indicator signifies that the room is occupied.

10. A control unit according to claim 8 further comprising a switch for providing power to said second and third indicators so that neither of said second and third indicators operate regardless of the state of said timer.

11. A control unit according to claim 8 further comprising a jack providing external interface to said first, second and third indicators.

12. A control unit according to claim 11 further comprising a remote indicator unit having first, second and third indicators operating in slave configuration with first, second and third indicators of said control unit, said remote indicator unit interfacing with said control unit through said jack.

13. A control unit according to claim 8 wherein said means operable comprises a relay having normally open and normally closed contacts connected to said second and third indicators, respectively, the coil of said relay being operated in accordance with said timer.

14. A method for using the apparatus of claim 8, wherein said first indicator is used to indicate that the start of the procedure is imminent, said second indicator is used to indicate that the procedure has commenced, and said third indicator is used to indicate that said procedure is complete.

15. A method for using the apparatus of claim 9, wherein said first indicator is used to indicate that the start of the procedure is imminent and that the room is occupied, said second indicator is used to indicate that the procedure has commenced, and said third indicator is used to indicate that said procedure is complete.

16. A control unit according to claim 8, further comprising a switch manually operable to apply power to said control unit, whereby said first indicator is actuated.

* * * * *

UNITED STATES PATENT AND TRADEMARK OFFICE

CERTIFICATE OF CORRECTION

PATENT NO. : 5,059,943

DATED : October 22, 1991

INVENTOR(S) : Peter J. LoBello

It is certified that error appears in the above-identified patent and that said Letters Patent is hereby corrected as shown below:

In the drawing, in Figure 1, please reconnect conductor B1 from timer 10 to indicator 5 as shown:

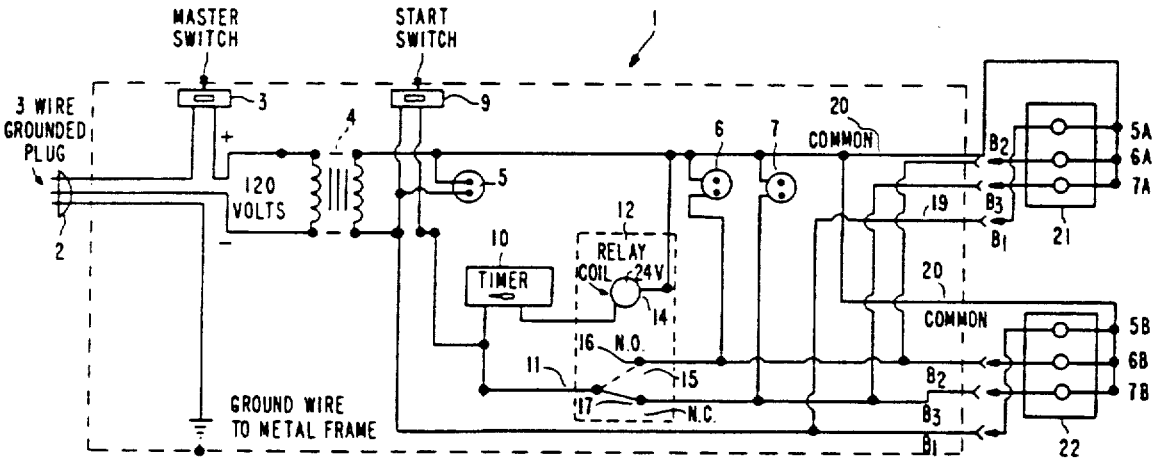

Column 2, line 15, delete "a".

Column 3, line 9, insert --a-- before "single".

Signed and Sealed this

Twenty-fourth Day of August, 1993

Bruce Lehman

*Attest:*

BRUCE LEHMAN

*Attesting Officer*

*Commissioner of Patents and Trademarks*